United States Patent [19]

Nielsen

[11] Patent Number: 4,889,343

[45] Date of Patent: Dec. 26, 1989

[54] GOLF SWING TRAINER

[75] Inventor: Thomas F. Nielsen, Albuquerque, N. Mex.

[73] Assignee: N & S Ltd., Albuquerque, N. Mex.

[21] Appl. No.: 271,435

[22] Filed: Nov. 15, 1988

[51] Int. Cl.[4] ..... A63B 69/36

[52] U.S. Cl. ..... 273/186 A; 273/81 C; 273/193 B

[58] Field of Search ..... 273/186 A, 193 R, 193 A, 273/193 B, 194 R, 194 A, 194 B, 186 R, 186 C, 183 D

[56] References Cited

U.S. PATENT DOCUMENTS

| | | | |
|---|---|---|---|
| 1,529,305 | 3/1925 | Gatke | 273/186 A |
| 2,225,839 | 12/1940 | Moore | 273/81 C |
| 3,215,437 | 11/1965 | Webb | 273/186 A |
| 3,317,211 | 5/1967 | Debski | 273/186 A |
| 3,351,346 | 11/1967 | Strahan | 273/193 |
| 3,565,444 | 2/1971 | La Rocca | 273/186 A |
| 3,606,340 | 9/1971 | Tiller | 273/186 A |
| 4,249,762 | 2/1981 | Richards | 273/193 A |
| 4,511,147 | 4/1985 | Olsen | 273/193 A |
| 4,576,378 | 3/1986 | Backus | 273/186 A |
| 4,826,168 | 5/1989 | McGuire et al. | 273/81 C |

*Primary Examiner*—George J. Marlo

*Attorney, Agent, or Firm*—Wegner & Bretschneider

[57] ABSTRACT

A golf club swing trainer has a handle portion and a shank portion connected together by a pivotable connecting assembly. One or more weights are connected to, and off-set from, the lower part of the shank portion. In use, if the user does not use proper arm, wrist and shoulder movement to form a proper swing plane, the off-set weights will cause a large torque to be generated around the axis of the club, causing the shank portion to rotate around the longitudinal axis of the handle portion.

8 Claims, 1 Drawing Sheet

GOLF SWING TRAINER

This invention relates to a practice golf club which helps teach the user a proper golf swing.

BACKGROUND OF THE INVENTION

Golf is a notoriously difficult game to play. In a golf swing, numerous factors affect whether the golf ball will be struck properly. The movement of the hands, feet, elbows, shoulders, hips, knees and feet all must combine to move the golf club in the proper swing plane. Only by learning to control these factors in each and every swing can the golfer consistently hit good golf shots. It is the job of a teaching professional to teach a golfer to control these factors in a coordinated sequence of action. When coordinated properly, the golfer's swing is said to be "In Line".

In a proper In-Line golf swing, there should be little to no torque created around the longitudinal axis of the club. If such a torque is created, it shows that the golfer is not using the correct wrist and shoulder movement, and thus is not forming a proper swing plane.

Numerous devices have been developed which are intended to teach a proper golf swing. However, none of these devices teach a proper swing plane by teaching the golfer to minimize the torque created around the longitudinal axis of the club.

SUMMARY OF THE INVENTION

Therefore, it is an object of this invention to create a swing training club which teaches a proper swing plane by training the golfer to reduce the torque created around the longitudinal axis of the club.

It is a further object of the invention to create such a club which allows the user to both see and feel when a correct swing is taken.

It is a further object to create such a club which is durable, and yet relatively simple and inexpensive to manufacture.

These and other objects are fulfilled by a golf swing training club having a shank portion and handle portion which are connected together by a pivotable connecting assembly. The connecting assembly allows the shank portion to pivot around the longitudinal axis of the handle portion. One or more weights are connected to the lower part of the shank portion, and are off-set from the remainder of the shank portion. Therefore, when the training club, which is swung like a normal golf club, is not swung correctly, the off-set weights create a large torque around the longitudinal axis of the club, causing the shank portion to pivot with respect to the handle portion, so that the user can both see and feel that he has not taken a correct swing.

It is preferable that a friction-adjusting member be included in the connection assembly, which, by adjusting the friction between the shank portion and the handle portion, can adjust the ease with which the shank portion can pivot relative to the handle portion.

BRIEF DESCRIPTION OF THE DRAWINGS

The preferred embodiment will be described with reference to the drawings, in which.

DESCRIPTION OF THE PREFERRED EMBODIMENT

Figure 1:
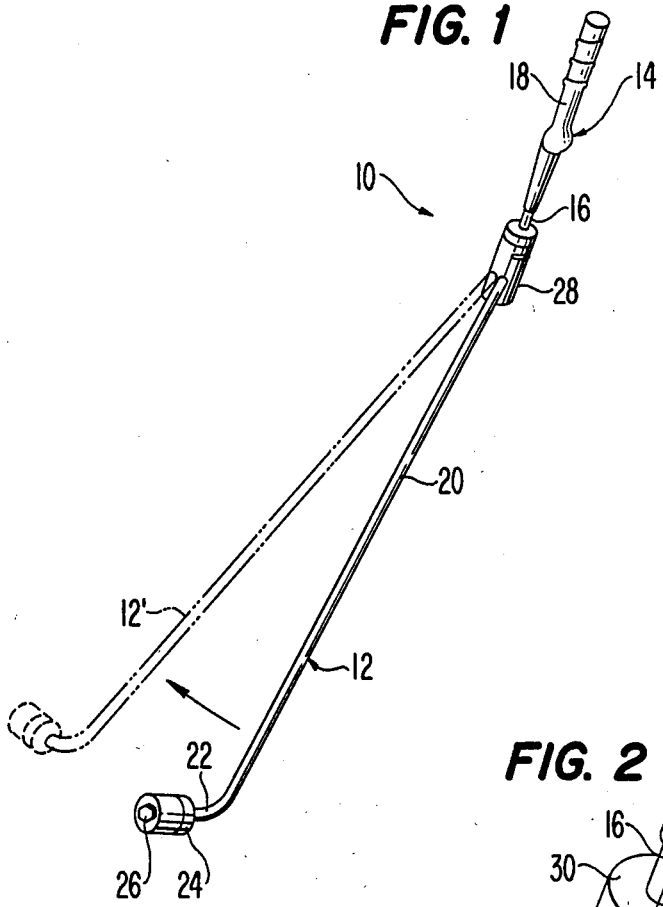
FIG. 1 is a perspective view of the golf swing training club according to the present invention.
Figure 2:
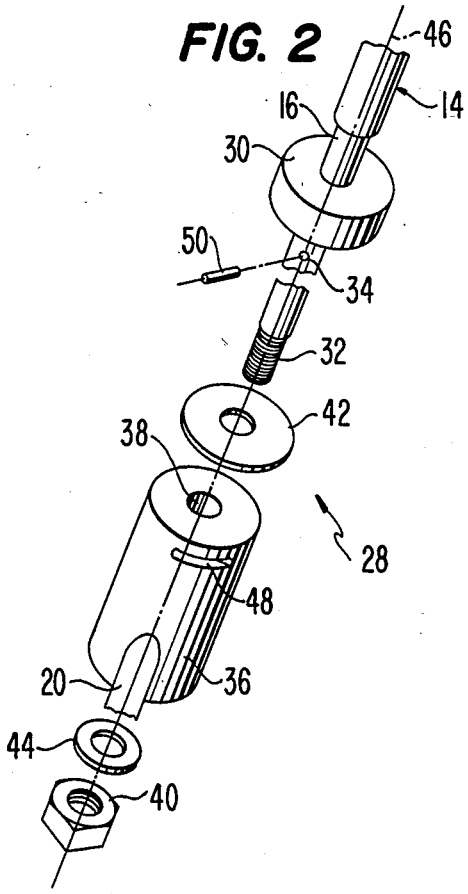
FIG. 2 is an exploded perspective view of the pivotable connection assembly of the training club of FIG. 1.

In FIG. 1, a training club designated generally at 10 is made up of a shank portion 12 and a handle portion 14. The handle portion 14 consists of a shaft 16, preferably made of aluminum, over which a grip 18 is placed. As seen in FIG. 1, the grip 18 preferably is contoured so as to keep the user's hands in the correct position. The shank portion consists of a shaft 20, also preferably made of aluminum, which has a bent end portion 22. One or more weights 24 are held onto the bent end portion by a looking bolt 26. As is clear from FIG. 1, because of the bent end portion, the weights are off-set from the axis of shaft 20. The shank portion and the handle portion are pivotably connected together by a pivotable connection assembly 28, which is shown in further detail in FIG. 2. Shaft 16 has an annular collar 30 and a threaded end portion 32, as well as an opening 34 disposed between the collar and the threaded end portion. Shaft 20, on the other hand, is connected to an annular pivot member 36, which has an opening 38 for receiving the end of the shaft 16. Lock nut 40 is threaded onto the end portion 32 to connect the shank portion and the handle portion. When assembled, the pivot member 36 abuts against the collar 30, with low-friction washers 42 and 44, preferably made of a synthetic resin polymer such as TEFLON (polytetrafluoroethylene), interposed between the pivot member 36 and the collar 30, and between the pivot member and the nut 40. With this arrangement, the pivot member, and consequently the shank portion 12, can rotate around the longitudinal axis 46 of the handle portion. The amount of friction between the pivot member and the collar can be adjusted by adjusting the lock nut.

A rotation control slot 48 is formed in pivot member 36. The slot extends a predetermined angular range, preferably 90°, around the circumference of the pivot member. A control pin 50, preferably made of hardened steel, is fitted into the opening 34 in shaft 16 and extends radially outward from the shaft 16 into the slot 48. Thus, the pin and slot together act to prevent rotation of the pivot member more than 90°.

In use, the training club is held so that bent portion 22 points away from the user. A normal swing is then taken. If proper hand and shoulder motion is employed, and the plane of the swing is proper, then little torque will be created around the longitudinal axis of the handle portion, an the shank portion will not pivot with respect to the handle portion. However, if these elements of the swing are not employed correctly, then the large torque caused by the off-set weights will cause the pivot member, and consequently the shank portion, to rotate and assume the position 12′ shown in FIG. 1.

It should be noted that shaft 20 is connected to the side of the pivot member 36 so that the axis of the shaft 20 is off-set from, but generally parallel to, the axis 46 of the handle portion. By off-setting the shaft 20 in this manner, a larger twisting torque is created when an improper swing is made.

Various modifications of the above description are possible without departing from the spirit and scope of the invention. The weights need not be of the type shown, but may, for example, be shaped as a normal wood or iron club head. A different type of grip may be employed. The dimensions of the various elements can be changed. Therefore, the scope of the invention should be interpreted not from the foregoing description, but from the following claims.

I claim:

1. A golf swing training club, comprising:

a handle portion having a longitudinal axis;

a shank portion having a shaft, the shaft having an axis, and at least one weight connected to the shaft and off-set from the axis thereof; and connecting means pivotably connecting the handle portion and the shank portion so that the shank portion can pivot around the longitudinal axis of the handle portion in response to an improper swing, but said pivot will not occur if a proper swing is executed.

2. The training club as claimed in claim 1, wherein said connecting means comprises frictional adjusting means for adjusting friction between the shank portion and the handle portion.

3. The training club as claimed in claim 1, wherein said shaft has a bent end portion, bent away from the axis of the shaft, to which the weight is attached.

4. The training club as claimed in claim 1, wherein said connecting means comprises control means for allowing the shank portion to rotate with respect to the handle portion only over a predetermined angular range.

5. A golf swing training club, comprising:

a handle portion having a first shaft which has a longitudinal axis:

a shank portion having a second shaft, the second shaft having an axis, and at least one weight connected to the second shaft and off-set from the axis thereof; and connecting means for pivotably connecting the handle portion and the shank portion so that the shank portion can pivot around the longitudinal axis of the handle portion, said connecting means comprising a collar connected to the first shaft, a pivot member fixed to the second shaft and having an opening, a threaded end portion at the end of the first shaft, and a lock nut threaded onto the threaded end portion, wherein the first shaft extends through the opening in the pivot member so that the pivot member abuts against the collar.

6. The training club as claimed in claim 5, further comprising a first synthetic resin polymer washer disposed between the pivot member and the collar, and a second synthetic resin polymer washer disposed between the pivot member and the lock nut, wherein friction between the shank portion and the handle portion as they rotate with respect to each other can be adjusted by adjusting the lock nut.

7. The training club as claimed in claim 5, further comprising a pin located on the first shaft between the threaded end portion and the collar and extending radially outward from first shaft, wherein said pivot member has a control slot which extends over a predetermined angular range and which receives the pin so that the shank portion can rotate with respect to the handle portion only over the predetermined angular range.

8. The training club as claimed in claim 5, wherein said pivot member is annular in shape and has an outer surface, and the second shaft is connected to the outer surface of the pivot member so that the axis of the second shaft is off-set from the longitudinal axis of the handle portion.

* * * * *